US011264725B2

(12) United States Patent
Wang et al.

(10) Patent No.: US 11,264,725 B2
(45) Date of Patent: Mar. 1, 2022

(54) ANTENNA APPARATUS AND TERMINAL

(71) Applicant: Huawei Technologies Co., Ltd., Shenzhen (CN)

(72) Inventors: Hanyang Wang, Reading (GB); Chien-Ming Lee, Shanghai (CN); Xuefei Zhang, Shenzhen (CN); Lijun Ying, Shanghai (CN); Liang Xue, Shanghai (CN); Jiaqing You, Shanghai (CN); Lei Wang, Shanghai (CN); Yue Shi, Shenzhen (CN); Dong Yu, Shanghai (CN); Guoping Wu, Shenzhen (CN); Bo Huang, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 224 days.

(21) Appl. No.: 16/067,500

(22) PCT Filed: Dec. 31, 2015

(86) PCT No.: PCT/CN2015/100065
§ 371 (c)(1),
(2) Date: Jun. 29, 2018

(87) PCT Pub. No.: WO2017/113270
PCT Pub. Date: Jul. 6, 2017

(65) Prior Publication Data

US 2019/0027830 A1 Jan. 24, 2019

(51) Int. Cl.
*H01Q 13/18* (2006.01)
*H01Q 1/50* (2006.01)
(Continued)

(52) U.S. Cl.
CPC ..... *H01Q 13/18* (2013.01); *H01Q 1/243* (2013.01); *H01Q 1/38* (2013.01); *H01Q 1/50* (2013.01);
(Continued)

(58) Field of Classification Search
CPC ..... H01Q 5/328; H01Q 5/314; H01Q 5/371; H01Q 1/50; H01Q 1/38; H01Q 13/18;
(Continued)

(56) References Cited

U.S. PATENT DOCUMENTS 4,209,790 A * 6/1980 Newcomb ..... H01Q 9/32 343/830
5,246,438 A * 9/1993 Langberg ..... A61B 18/08 600/374
(Continued)

FOREIGN PATENT DOCUMENTS

CN 1808768 A 7/2006
CN 101084604 A 12/2007
(Continued)

OTHER PUBLICATIONS

Foreign Communication From A Counterpart Application, European Application No. 15911898.3, Extended European Search Report dated Jan. 16, 2019, 16 pages.
(Continued)

*Primary Examiner* — Graham P Smith
*Assistant Examiner* — Jae K Kim
(74) *Attorney, Agent, or Firm* — Conley Rose, P.C.

(57) ABSTRACT

An antenna apparatus and a terminal, where the antenna apparatus includes an antenna body and at least one stub, where a feed terminal is disposed on the antenna body, one end of the stub is electrically coupled to a coupling point between the feed terminal and a first open-circuit end of the antenna body, and the other end of the stub is an open-circuit
(Continued)

end, and an antenna body length between the coupling point and the feed terminal is a half of a wavelength corresponding to a specified operating frequency, and a length of the stub is one quarter of the wavelength corresponding to the specified operating frequency.

20 Claims, 16 Drawing Sheets

(51) Int. Cl.

| | |
|---|---|
| ***H01Q 1/24*** | (2006.01) |
| ***H01Q 1/38*** | (2006.01) |
| ***H01Q 5/328*** | (2015.01) |
| ***H01Q 5/371*** | (2015.01) |
| ***H01Q 9/42*** | (2006.01) |
| ***H01Q 5/314*** | (2015.01) |
| *H01Q 1/27* | (2006.01) |
| *H01Q 1/22* | (2006.01) |

(52) U.S. Cl.
CPC ..... *H01Q 5/314* (2015.01); *H01Q 5/328* (2015.01); *H01Q 5/371* (2015.01); *H01Q 9/42* (2013.01); *H01Q 1/2266* (2013.01); *H01Q 1/273* (2013.01)

(58) Field of Classification Search
CPC ..... H01Q 9/42; H01Q 1/243; H01Q 1/2266; H01Q 1/273
See application file for complete search history.

(56) References Cited

U.S. PATENT DOCUMENTS

| | | | | |
|---|---|---|---|---|
| 5,706,016 | A * | 1/1998 | Harrison, II | H01Q 9/36 343/749 |
| 7,161,543 | B2 * | 1/2007 | Cheng | G06F 1/1616 343/702 |
| 7,260,424 | B2 | 8/2007 | Schmidt | |
| 8,754,801 | B1 * | 6/2014 | Ross | H01P 1/20 342/16 |
| 8,988,292 | B2 * | 3/2015 | Hotta | H01Q 7/00 343/702 |
| 2002/0005814 | A1 * | 1/2002 | Stengel, Jr. | H01Q 5/50 343/850 |
| 2002/0180650 | A1 | 12/2002 | Pankinaho et al. | |
| 2005/0259018 | A1 * | 11/2005 | Schadler | H01Q 21/08 343/742 |
| 2006/0132360 | A1 * | 6/2006 | Caimi | H01Q 1/243 343/700 MS |
| 2006/0158379 | A1 | 7/2006 | Ishimiya | |
| 2006/0281423 | A1 * | 12/2006 | Caimi | H01Q 9/045 455/129 |
| 2007/0222697 | A1 * | 9/2007 | Caimi | H01Q 1/50 343/861 |
| 2008/0158074 | A1 | 7/2008 | Villarroel et al. | |
| 2009/0002248 | A1 | 1/2009 | Zhao et al. | |
| 2012/0188134 | A1 | 7/2012 | Hotta et al. | |
| 2012/0262347 | A1 | 10/2012 | Tiang | |
| 2013/0038494 | A1 | 2/2013 | Kuonanoja | |
| 2013/0285870 | A1 * | 10/2013 | Hotta | H01Q 9/42 343/843 |
| 2014/0057578 | A1 | 2/2014 | Chan et al. | |
| 2015/0054698 | A1 | 2/2015 | Kerr et al. | |
| 2015/0057054 | A1 | 2/2015 | Su et al. | |
| 2016/0294060 | A1 | 10/2016 | Meng et al. | |
| 2017/0012357 | A1 | 1/2017 | Zhang et al. | |
| 2017/0047642 | A1 | 2/2017 | Li et al. | |
| 2017/0302005 | A1 * | 10/2017 | Rose | H01Q 21/0006 |

FOREIGN PATENT DOCUMENTS

| | | | |
|---|---|---|---|
| CN | 102714347 | A | 10/2012 |
| CN | 103633419 | A | 3/2014 |
| CN | 203466294 | U | 3/2014 |
| CN | 104347927 | A | 2/2015 |
| EP | 2479838 | A1 | 7/2012 |
| JP | 2005210523 | A | 8/2005 |
| JP | 2012156696 | A | 8/2012 |
| WO | 2011076582 | A1 | 6/2011 |
| WO | 2014030031 | A1 | 2/2014 |
| WO | 2015074251 | A1 | 5/2015 |
| WO | 2015109943 | A1 | 7/2015 |
| WO | 2015165007 | A1 | 11/2015 |

OTHER PUBLICATIONS

Foreign Communication From A Counterpart Application, European Application No. 15911898.3, Partial Supplementary European Search Report dated Nov. 29, 2018, 14 pages.
Foreign Communication From A Counterpart Application, PCT Application No. PCT/CN2015/100065, English Translation of International Search Report dated Sep. 28, 2016, 2 pages.
Foreign Communication From A Counterpart Application, PCT Application No. PCT/CN2015/100065, English Translation of Written Opinion dated Sep. 28, 2016, 3 pages.
Machine Translation and Abstract of Japanese Publication No. JP2005210523, Aug. 4, 2005, 21 pages.
Foreign Communication From A Counterpart Application, Japanese Application No. 2018-534653, Japanese Office Action dated Aug. 27, 2019, 3 pages.
Foreign Communication From A Counterpart Application, Japanese Application No. 2018-534653, English Translation of Japanese Office Action dated Aug. 27, 2019, 3 pages.
Machine Translation and Abstract of Chinese Publication No. CN103633419, Mar. 12, 2014, 25 pages.
Machine Translation and Abstract of Chinese Publication No. CN104347927, Feb. 11, 2015, 19 pages.
Machine Translation and Abstract of Chinese Publication No. CN203466294, Mar. 5, 2014, 9 pages.
Foreign Communication From A Counterpart Application, Chinese Application No. 201580081834.2, Chinese Office Action dated Mar. 21, 2019, 9 pages.

* cited by examiner

ANTENNA APPARATUS AND TERMINAL

CROSS-REFERENCE TO RELATED APPLICATION

This application is a U.S. National Stage of International Patent Application No. PCT/CN2015/100065 filed on Dec. 31, 2015, which is hereby incorporated by reference in its entirety.

TECHNICAL FIELD

The present disclosure relates to communications technologies, and in particular, to an antenna apparatus and a terminal.

BACKGROUND

The continuous development of communications technologies is accompanied with continuous improvement of a handheld mobile terminal. From an aspect of function, a terminal needs to support multiple standards to adapt to continuous evolution of communications networks. From an aspect of appearance, today's mobile terminal is generally provided with a high screen-to-body ratio, and usually uses a metal industrial design (ID) to pursue a stylish appearance.

A monopole antenna, a planar inverted F antenna (PIFA), or the like is generally used in an existing terminal antenna design scheme. However, due to a shielding effect of metal, an existing terminal antenna usually has a large size, and needs to occupy large clearance space in order to ensure radiation performance of the terminal antenna.

SUMMARY

Embodiments of the present disclosure provide an antenna apparatus and a terminal in order to resolve a prior-art problem that a terminal needs to occupy large clearance space.

According to a first aspect of the present disclosure, an antenna apparatus is provided, including an antenna body and at least one stub, where a feed terminal is disposed on the antenna body, one end of the stub is electrically connected to a connection point between the feed terminal and a first open-circuit end of the antenna body, and the other end of the stub is an open-circuit end, and an antenna body length between the connection point and the feed terminal is a half of a wavelength corresponding to a specified operating frequency of the antenna apparatus, and a length of the stub is one quarter of the wavelength corresponding to the specified operating frequency.

In a possible implementation of the first aspect, three quarters of the wavelength corresponding to the specified operating frequency may be the same as an antenna body length between the feed terminal of the antenna apparatus and the open-circuit end of the stub.

In a possible implementation of the first aspect, the antenna apparatus further includes a low-frequency switching network and a first ground terminal, where one end of the low-frequency switching network is electrically connected between the feed terminal and the connection point, and the other end of the low-frequency switching network is electrically connected to the first ground terminal.

In a possible implementation of the first aspect, the antenna apparatus further includes a second ground terminal, where the second ground terminal is disposed between the feed terminal and a second open-circuit end of the antenna body.

In a possible implementation of the first aspect, the low-frequency switching network includes a single-pole multi-throw switch and a low-frequency matching component, where a fixed end of the single-pole multi-throw switch is connected between the feed terminal and the connection point, and the low-frequency matching component is electrically connected between a first movable end of the single-pole multi-throw switch and the first ground terminal, and a second movable end of the single-pole multi-throw switch is electrically connected to the first ground terminal.

In a possible implementation of the first aspect, the low-frequency matching component is an inductor or a capacitor.

In a possible implementation of the first aspect, the antenna apparatus operates on a first band, a second band, a third band, a fourth band, and a fifth band, the first band is between 698 megahertz (MHz) and 960 MHz, and the second band, the third band, the fourth band, and the fifth band are between 1710 MHz and 3600 MHz.

In a possible implementation of the first aspect, the second band, the third band, the fourth band, and the fifth band are between 1710 MHz and 2690 MHz.

In a possible implementation of the first aspect, the antenna apparatus operates on a first band, a second band, a third band, a fourth band, and a fifth band, the first band is between 698 MHz and 960 MHz, the second band is a preset band, and the preset band is 1427 MHz to 1495 MHz or 1448 MHz to 1511 MHz, or the preset band is used to support a Global Positioning System (GPS) or a Global Navigation Satellite System (GNSS), and the third band, the fourth band, and the fifth band are between 1710 MHz and 2690 MHz.

In a possible implementation of the first aspect, the first band is between 880 MHz and 960 MHz.

According to a second aspect of the present disclosure, a terminal is provided, including a printed circuit board and the antenna apparatus according to the first aspect, where a feed apparatus is disposed on the printed circuit board, and the feed terminal in the antenna apparatus is electrically connected to the feed apparatus.

According to a third aspect of the present disclosure, a terminal is provided, including a printed circuit board, a metal housing, and the antenna apparatus according to the first aspect, the printed circuit board is located inside the ground metal housing, the printed circuit board is electrically connected to the ground metal housing, and a feed apparatus is disposed on the printed circuit board, the ground metal housing has a hollow structure, and the antenna body in the antenna apparatus and the ground metal housing face each other to form a gap, and the feed terminal in the antenna apparatus is electrically connected to the feed apparatus.

In a possible implementation of the third aspect, the gap on the back of the terminal is U-shaped.

In a possible implementation of the third aspect, a width of the gap is less than or equal to 3 millimeters.

The antenna apparatus provided in the embodiments of the present disclosure includes the antenna body and the at least one stub, where the feed terminal is disposed on the antenna body, one end of the stub is electrically connected to the connection point between the feed terminal and the first open-circuit end of the antenna body, and the other end of the stub is an open-circuit end, and the antenna body length between the connection point and the feed terminal is a half of the wavelength corresponding to the specified operating frequency of the antenna apparatus, and the length of the stub is one quarter of the wavelength corresponding to the specified operating frequency. Compared with an existing terminal antenna, when the antenna apparatus is applied, the metal housing of the terminal may be used as the antenna body of the antenna apparatus, that is, a shape of the antenna body matches the metal housing. This disposition manner generally needs only a clearance area less than 3 millimeters. Therefore, when the antenna apparatus is used, an appearance design of the terminal can be fully used such that only small clearance space needs to be occupied while performance is ensured.

BRIEF DESCRIPTION OF DRAWINGS

To describe the technical solutions in the embodiments of the present disclosure or in the prior art more clearly, the following briefly introduces the accompanying drawings required for describing the embodiments. The accompanying drawings in the following description show some embodiments of the present disclosure, and a person of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly and completely describes the technical solutions in the embodiments of the present disclosure with reference to the accompanying drawings in the embodiments of the present disclosure. The described embodiments are some but not all of the embodiments of the present disclosure. All other embodiments obtained by a person of ordinary skill in the art based on the embodiments of the present disclosure without creative efforts shall fall within the protection scope of the present disclosure.

An antenna apparatus provided in the embodiments of the present disclosure may be applied to a terminal, and the terminal may be a portable terminal or another suitable communication terminal. For example, the terminal may be a laptop computer, a tablet, a small device or a miniature device such as a wristwatch device, a wristband device, or another wearable device, a cellular phone, a media player, a set top box, a desktop computer, a computer monitor integrating with a computer, or another suitable terminal.

The terminal may have a display installed in a housing. The display may be a touchscreen that incorporates a capacitive contact electrode or that may be insensitive to a touch. The display may include an image pixel that is constituted by a light emitting diode, an organic light emitting diode, a plasma unit, an electrowetting pixel, an electrophoretic pixel, a liquid crystal display component, or another suitable image pixel structure. A protective glass layer may cover a surface of the display. Protective glass may have one or more openings such as an opening that is used to accommodate a button.

The housing may be constituted by plastic, glass, ceramic, a fiber composite, metal (for example, stainless steel, aluminum, or the like), another suitable material, or a combination of these materials. In some cases, the housing or some parts of the housing may be constituted by a dielectric or another material with low electrical conductivity. In another case, the housing or at least some structures that constitute the housing may be constituted by a metal component.

Theoretically, the terminal may be used to support any related communication band. The terminal may include one or more antenna apparatuses. For example, the terminal may include an antenna apparatus that is configured to support local area network communication, voice and data cellular phone communication, GPS communication or other satellite navigation system communication, BLUETOOTH communication, or the like.

Figure 1:
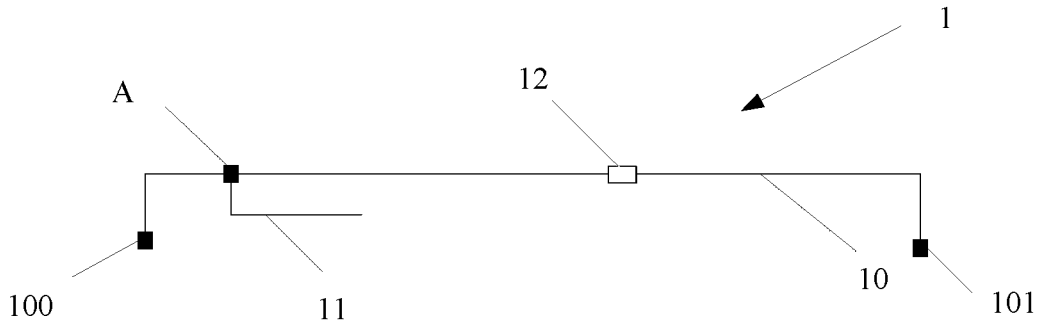
FIG. 1 is a schematic structural diagram of an antenna apparatus according to Embodiment 1 of the present disclosure.

FIG. 1 is a schematic structural diagram of an antenna apparatus according to Embodiment 1 of the present disclosure. As shown in FIG. 1, the antenna apparatus 1 includes an antenna body 10 and a stub 11. A feed terminal 12 is disposed on the antenna body 10.

Further, one end of the stub 11 is electrically connected to a connection point A between the feed terminal 12 and a first open-circuit end 100 of the antenna body 10, and the other end of the stub 11 is an open-circuit end.

The feed terminal 12 is configured to electrically connect to a feedpoint (Feed) of a feed circuit in a terminal in which the antenna apparatus 1 is located, and the terminal herein may be a mobile device, a user terminal, radio communications equipment, or the like. The feed circuit is configured to provide an input signal for the antenna apparatus 1, and is configured to process a transmit signal generated by a terminal transmitter to provide to the antenna apparatus 1, or after the antenna apparatus 1 receives a signal, process the received signal to send to a receiver of the terminal.

To ensure that the antenna apparatus 1 can cover sufficient bands, a location and a length of the stub 11 of the antenna apparatus 1 are limited.

From an aspect of location, a length of the antenna body 10 between the connection point A and the feed terminal 12 is a half of a wavelength corresponding to a specified operating frequency of the antenna apparatus 1. From an aspect of length, the length of the stub 11 is one quarter of the wavelength corresponding to the specified operating frequency.

The following describes an operating principle of the antenna apparatus 1 in detail with reference to FIG. 1. Based on a specific structure of the antenna apparatus 1, the antenna apparatus 1 may operate in five operating modes, including one low-frequency mode and four high-frequency modes. Further, according to an electromagnetic wave principle, when a wavelength of an electromagnetic wave and a length of an antenna are the same, resonance can be implemented. Therefore, the lengths of the antenna body 10 and stub 11 may be set according to an operating frequency of the antenna apparatus 1 in order to implement resonance in the foregoing five modes. For example, the length of the antenna body 10 between the feed terminal 12 and the first open-circuit end 100 of the antenna body 10 may be set to be greater than a length of the antenna body 10 between the feed terminal 12 and a second open-circuit end 101 of the antenna body 10 such that the antenna body 10 between the feed terminal 12 and the first open-circuit end 100 of the antenna body 10 is used as a first branch of the antenna apparatus 1, and the first branch is used to radiate a low frequency signal. In addition, the stub 11 is further disposed on the antenna apparatus 1. Therefore, the antenna body 10 between the feed terminal 12 and the open-circuit end of the stub 11 may constitute a second branch of the antenna apparatus 1, and the second branch is used to radiate a high frequency signal. Moreover, the antenna body 10 between the feed terminal 12 and the second open-circuit end 101 of the antenna body 10 is used as a third branch of antenna apparatus 1, and the third branch may cooperate with the first branch and second branch to radiate a high frequency signal. It should be noted that the low frequency signal and high frequency signal herein are relative, and are not signals of a specific band.

The foregoing first branch can generate quarter-wavelength resonance. The resonance is the low-frequency mode in which the antenna apparatus 1 operates. This indicates that the antenna apparatus 1 can cover a first band, that is, the length of the antenna body 10 between the feed terminal 12 and the first open-circuit end 100 is one quarter of a wavelength corresponding to a specified operating frequency in the first band. For the antenna body 10, half-wavelength resonance, namely, half-wavelength resonance, may also be generated between the first open-circuit end 100 and the second open-circuit end 101 that are of the antenna body 10. The resonance is a first high-frequency mode in which the antenna apparatus 1 operates. This indicates that the antenna apparatus 1 can cover a second band, that is, a length of the antenna body 10 between the first open-circuit end 100 and the second open-circuit end 101 is a half of a wavelength corresponding to a specified operating frequency in the second band. The foregoing second branch may also generate three-quarter-wavelength resonance. The resonance is a second high-frequency mode in which the antenna apparatus 1 operates. This indicates that the antenna apparatus 1 can cover a third band. The length of the antenna body 10 between the feed terminal 12 and the connection point A plus the length of the stub 11 equals three quarters of a wavelength corresponding to a specified operating frequency in the third band. In addition, the foregoing third branch may generate single-wavelength resonance. The resonance is a third high-frequency mode in which the antenna apparatus 1 operates. This indicates that the antenna apparatus 1 can cover a fourth band, that is, the length of the antenna body 10 between the feed terminal 12 and the first open-circuit end 101 is one quarter of a wavelength corresponding to a specified operating frequency in the fourth band. Moreover, in addition to the resonance of the foregoing two modes, three-quarter-wavelength resonance may also be generated between the feed terminal 12 and the first open-circuit end 100. The resonance is a fourth high-frequency mode in which the antenna apparatus 1 operates. This indicates that the antenna apparatus 1 can cover a fifth band. The length of the antenna body 10 between the feed terminal 12 and the first open-circuit end 100 is one quarter of a wavelength corresponding to a specified operating frequency in the fifth band.

According to the foregoing description, the length of the antenna body 10 between the feed terminal 12 and the connection point A plus the length of the stub 11 equals three quarters of the wavelength corresponding to the specified operating frequency in the third band. A radiator that actually generates resonance that covers the third band is constituted by two parts, the antenna body 10 between the feed terminal 12 and the connection point A and the stub 11. The length of the stub 11 is one quarter of the wavelength corresponding to the specified operating frequency in the third band, and the length of the antenna body 10 between the feed terminal 12 and the connection point A is a half of the wavelength corresponding to the specified operating frequency in the third band.

It should be noted that the foregoing antenna apparatus 1 can cover five bands, and the specified operating frequency in each band may be selected according to an actual need. For example, a low frequency may be selected from each band to serve as the foregoing specified operating frequency.

In addition, in practice, the lengths of the antenna body 10 and the stub 11, and locations of the feed terminal 12 and the connection point A that are on the antenna body 10 may be adjusted in order to implement coverage of different bands.

In addition, it should be further noted that one stub 11 is used merely as an example in this embodiment, and is not used as a limitation. Actually, a quantity, a specific location, a specific length, and the like of the stub 11 may be adjusted in order to implement coverage of different quantities of bands. Further, when multiple stubs are disposed, the stubs may generally be disposed in a location with a large current according to current distribution on the antenna body 10 in order to generate more resonance to cover more bands. For example, a signal is outputted or inputted at the feed terminal 12, and therefore, a current in a location of the feed terminal 12 is the greatest, and multiple stubs may be disposed in a location near the feed terminal 12. Moreover, in practice, a material of the stub 11 is the same as that for producing an antenna in the prior art, such as plated copper and alloy.

It should be noted that a shape of the antenna apparatus 1 shown in FIG. 1 is merely an example, and is not used as a limitation. When the antenna apparatus is applied, a metal housing of the terminal may be used as the antenna body of the antenna apparatus, that is, a shape of the antenna body matches the metal housing. This disposition manner can reduce clearance space needed by a terminal antenna, and generally only a clearance area less than 3 millimeters is needed.

The antenna apparatus 1 provided in this embodiment of the present disclosure includes the antenna body 10 and at least one stub 11, where the feed terminal 12 is disposed on the antenna body 10, one end of the stub 11 is electrically connected to the connection point A between the feed terminal 12 and the first open-circuit end 100 of the antenna body 10, and the other end of the stub 11 is an open-circuit end, and the antenna body 10 length between the connection point A and the feed terminal 12 is a half of the wavelength corresponding to the specified operating frequency of the antenna apparatus 1, and the length of the stub 11 is one quarter of the wavelength corresponding to the specified operating frequency. Compared with an existing terminal antenna, when the antenna apparatus 1 is used, an appearance design of the terminal can be fully used such that only small clearance space needs to be occupied while performance is ensured.

Figure 2:
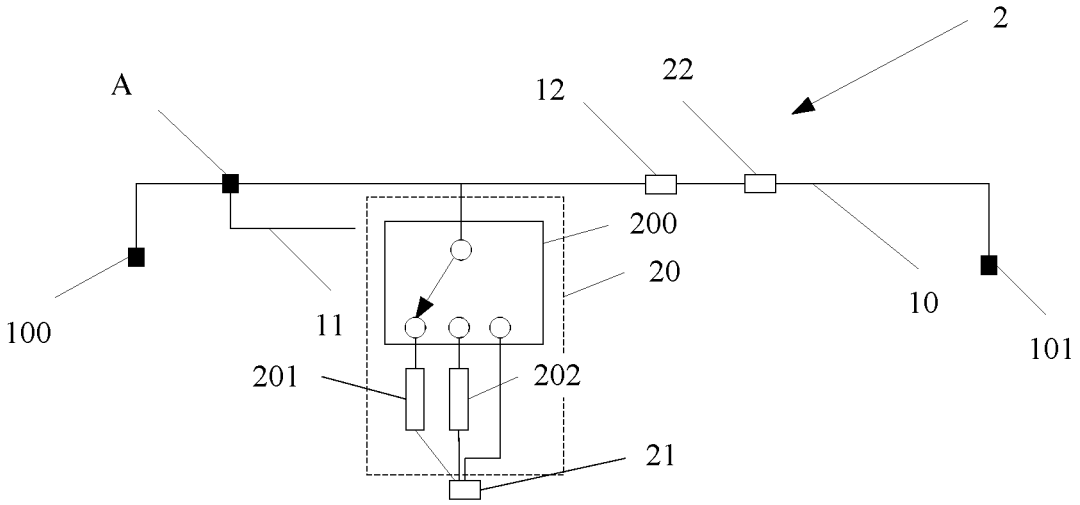
FIG. 2 is a schematic structural diagram of an antenna apparatus according to Embodiment 2 of the present disclosure.

FIG. 2 is a schematic structural diagram of an antenna apparatus according to Embodiment 2 of the present disclosure. As shown in FIG. 2, the antenna apparatus 2 includes an antenna body 10 and at least one stub 11, where a feed terminal 12 is disposed on the antenna body 10. A connection manner and a length limitation that are of the stub 11 are the same as those in Embodiment 1, and details are not described herein.

Moreover, the antenna apparatus 2 further includes a low-frequency switching network 20 (a dashed box shown in FIG. 2 is only used to indicate that a component, a unit, and a line in the dashed box constitute the low-frequency switching network 20, and a dashed line itself has no practical meaning) and a first ground terminal 21. One end of the low-frequency switching network 20 is electrically connected between the feed terminal 12 and a connection point A, and the other end of the low-frequency switching network 20 is electrically connected to the first ground terminal 21.

As in Embodiment 1, the antenna apparatus 2 may also operate in five modes, including one adjustable low-frequency mode and four high-frequency modes. The low-frequency switching network 20 is connected to a first branch between the feed terminal 12 and a first open-circuit end 100, and the first branch corresponds to the low-frequency mode of the antenna apparatus 2. Therefore, an internal structure of the low-frequency switching network 20 may be set to make the low-frequency switching network 20 match the low-frequency mode of the antenna apparatus in order to adjust a specific location of a first band covered by the antenna apparatus 2, and implement adjustable resonance of the low-frequency mode. Optionally, as shown in FIG. 2, the low-frequency switching network 20 includes a single-pole multi-throw switch and a low-frequency matching component. The single-pole multi-throw switch is used for switching such that the antenna body 10 and the first ground terminal 21 are directly connected, or are indirectly connected using the low-frequency matching component. Further, when the first ground terminal 21 is directly connected, the antenna apparatus 2 covers the first band described in Embodiment 1, and when the low-frequency matching component is connected, the foregoing first band shifts to a higher frequency or a lower frequency.

Optionally, as shown in FIG. 2, the foregoing low-frequency switching network 20 may include a single-pole three-throw switch 200 and two low-frequency matching components, that is, an inductor 201 and an inductor 202. A fixed end of the single-pole three-throw switch 200 is connected between the feed terminal 12 and the connection point A. The inductor 201 is electrically connected between one first movable end of the single-pole three-throw switch 200 and the first ground terminal 21, and the inductor 202 is electrically connected between the other first movable end of the single-pole three-throw switch 200 and the first ground terminal 21. A second movable end of the single-pole three-throw switch 200 is electrically connected to the first ground terminal 21. The first movable end herein is a movable end connected to the low-frequency matching component, a quantity of the first movable ends matches a quantity of the low-frequency matching components, and the second movable end is a movable end connected to the first ground terminal 21. Adding an inductor is equivalent to increasing a cabling length of an antenna, and therefore, adding an inductor is equivalent to changing an antenna length. In this way, the first band covered by the antenna apparatus 2 is adjusted. It should be noted that two inductors, that is, the inductor 201 and inductor 202 are used as an example herein, therefore, the single-pole three-throw switch 200 is three-throw. In a practical application, more low-frequency matching components may be disposed, and matched single-pole multi-throw switches may be configured. This is not limited herein. Moreover, it should be further noted that the foregoing inductor 201 and inductor 202 may be replaced with capacitors. For example, the foregoing two are two capacitors or one inductor and one capacitor. This is not limited herein.

Optionally, the antenna apparatus 2 may further include a second ground terminal 22. The second ground terminal 22 is disposed between the feed terminal 12 and a second open-circuit end 101 of the antenna body 10. A function of the second open-circuit end 101 is equivalent to a parallel distributed inductor for grounding. This can implement a matching effect similar to that of grounding a parallel inductor for the antenna apparatus 2. By this means, a fine tuning effect of a resonance frequency can also be achieved. Moreover, in a specific implementation, if the distributed inductor is not implemented using the foregoing second ground terminal 22, another manner is that a lumped inductor may be connected in parallel on a feeder connected to the feed terminal 12 to achieve the foregoing effect.

In addition, as described in Embodiment 1, the antenna apparatus 2 operates in five modes, that is, covers five bands. The five bands are respectively, a first band, a second band, a third band, a fourth band, and a fifth band. The foregoing first band corresponds to the low-frequency mode in which the antenna apparatus 2 operates, and the remaining four bands correspond to the high-frequency modes. The first band includes a first frequency and a second frequency, the second band includes a third frequency and a fourth frequency, the third band includes a fifth frequency and a sixth frequency, the fourth band includes a seventh frequency and an eighth frequency, and the fifth band includes a ninth frequency and a tenth frequency.

Figure 3A:
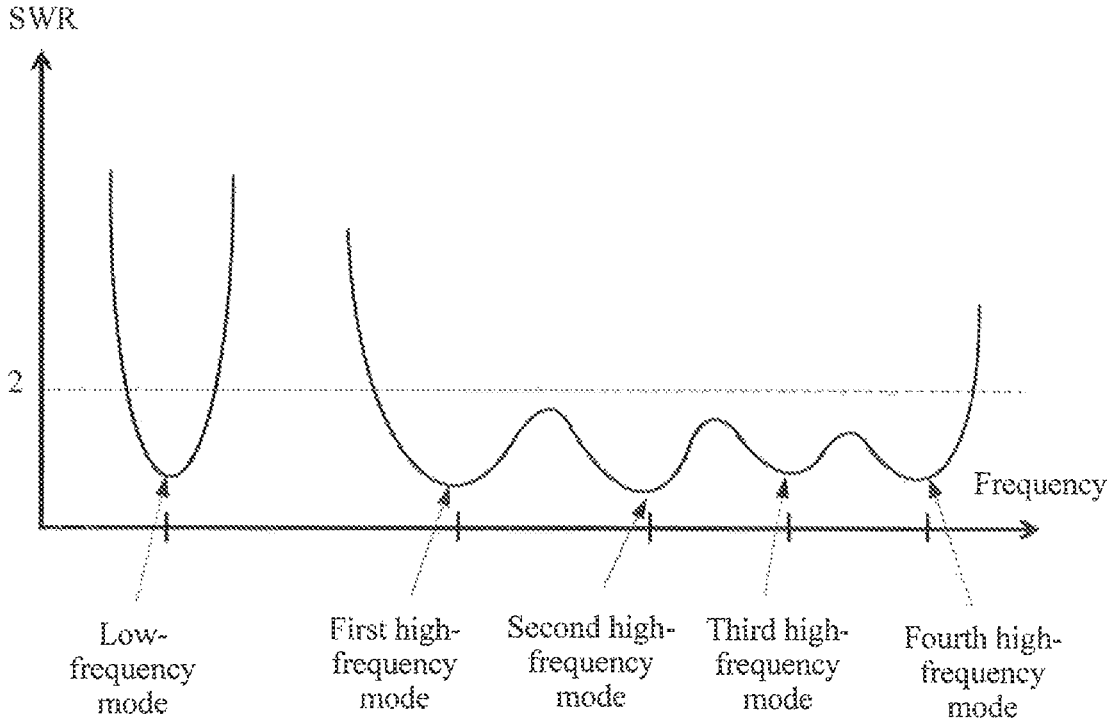
FIG. 3A is a schematic diagram of a standing wave ratio (also known as SWR) of an antenna apparatus according to Embodiment 2 of the present disclosure.

The following describes an operating principle of the antenna apparatus 2 in detail with reference to FIG. 3A. FIG. 3A is a schematic diagram of a standing wave ratio of the antenna apparatus 2, where a lateral axis represents a frequency in a unit of MHz, a longitudinal axis represents a voltage standing wave ratio (VSWR), and the VSWR may also be referred to as an SWR. The standing wave ratio is a ratio of a voltage amplitude at an antinode of a standing wave to a voltage amplitude at a valley of the standing wave, and is also referred to as a standing wave coefficient. The standing wave ratio includes a value. When the standing wave ratio is equal to 1, it means that impedance of a feed line fully matches impedance of an antenna. In this case, high-frequency energy is all radiated out by the antenna, and there is no energy reflection loss. When the standing wave ratio is 2, it means that there is a 10% energy loss, and 90% of the energy is radiated out by the antenna. When the standing wave ratio is infinite, it means total reflection and no energy is radiated out. The five modes of the antenna apparatus 2, that is, five resonance modalities, are shown from left to right in FIG. 3A. In the first band corresponding to the low-frequency mode, the antenna apparatus 2 can cover a frequency range from about 698 MHz to 960 MHz. In this case, the foregoing first frequency and second frequency are respectively 698 MHz and 960 MHz. The first to fourth high-frequency modes may be combined to cover a wide bandwidth, for example, 1710 MHz to 3600 MHz. Further, in a first high-frequency mode and a second high-frequency mode, resonance may be combined to cover a wide bandwidth. For example, the antenna apparatus 2 is controlled to cover a frequency from 1710 MHz to 2170 MHz. In this case, the foregoing third frequency is 1710 MHz, the sixth frequency is 2170 MHz, and the fourth frequency and the fifth frequency are respectively 1990 MHz and 2050 MHz. In a third high-frequency mode, the antenna apparatus 2 may be controlled to cover a band between 2050 MHz and 2500 MHz. In a fourth high-frequency mode, the antenna apparatus 2 is generally controlled to cover a frequency from 2500 MHz to 2690 MHz in order to support frequency division duplex (FDD) and time division duplex (TDD) bands. In this case, the foregoing ninth frequency and tenth frequency are respectively 2500 MHz and 2690 MHz.

Figure 3B:
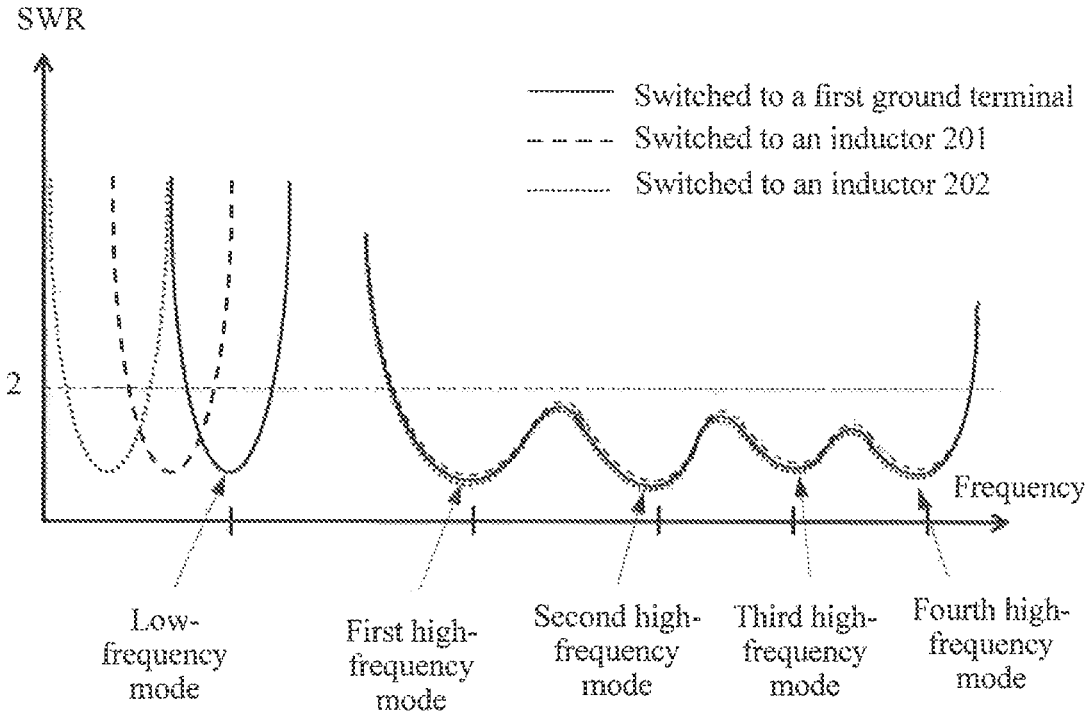
FIG. 3B is a schematic diagram of a standing wave ratio of an antenna apparatus according to Embodiment 2 of the present disclosure.
Figure 3C:
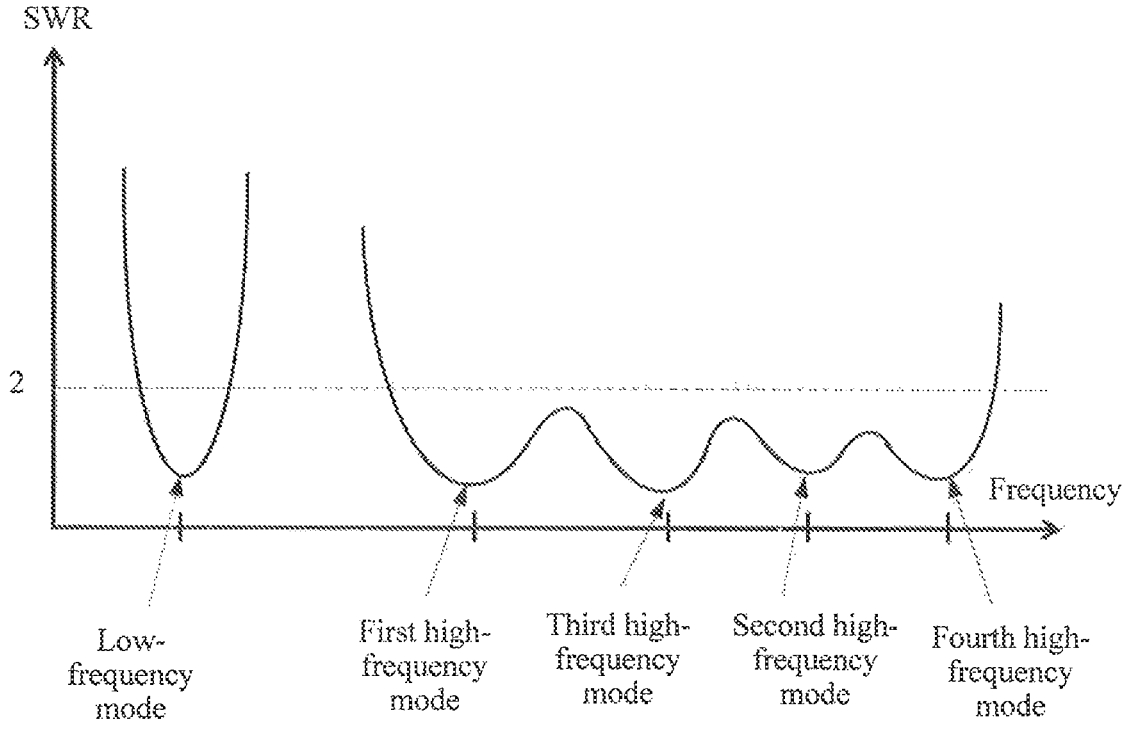
FIG. 3C is a schematic diagram of a standing wave ratio of an antenna apparatus according to Embodiment 2 of the present disclosure.
Figure 3D:
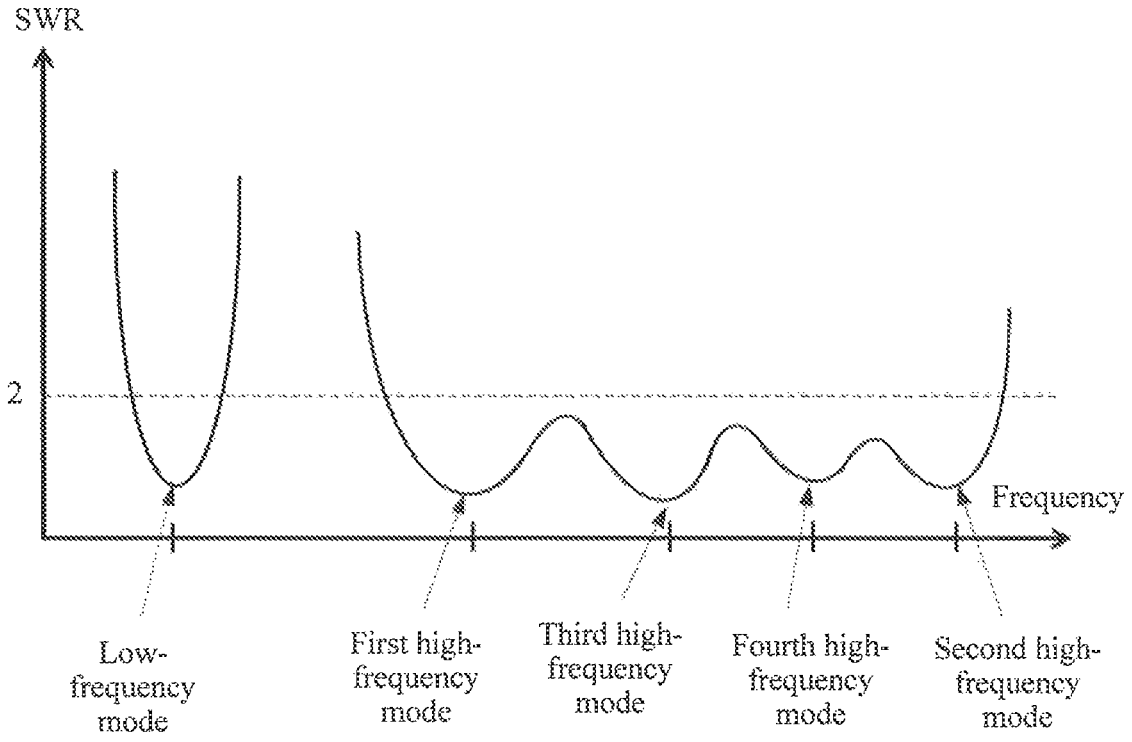
FIG. 3D is a schematic diagram of a standing wave ratio of an antenna apparatus according to Embodiment 2 of the present disclosure.

Certainly, according to an actual need, a band covered by the foregoing antenna apparatus 2 may be changed. For example, the first band 698 MHz to 960 MHz may be changed to cover 880 MHz to 960 MHz. In this case, the foregoing first frequency and second frequency are respectively 880 MHz and 960 MHz. The first to fourth high-frequency modes may be combined to cover a wide bandwidth, for example, to cover 1710 MHz to 2690 MHz, or extend to a higher band, for example, to cover 1710 MHz to 3600 MHz. Moreover, locations of the first to fourth high-frequency modes may be changed, and are not limited to a sequence shown in FIG. 3A. Details are shown in FIG. 3C and FIG. 3D, and are not described herein.

It should be noted that specific values of the five bands covered by the antenna apparatus 2 may be further adjusted by adjusting lengths of the antenna body 10 and stub 11 and locations of the feed terminal 12 and the connection point A. Therefore, in FIG. 3A, only five modes are marked on the lateral axis, but a specific value of a frequency covered by each mode is not marked on the lateral axis. Moreover, the specific values of the foregoing frequencies are merely examples, and are not used as limitations.

Figure 3E:
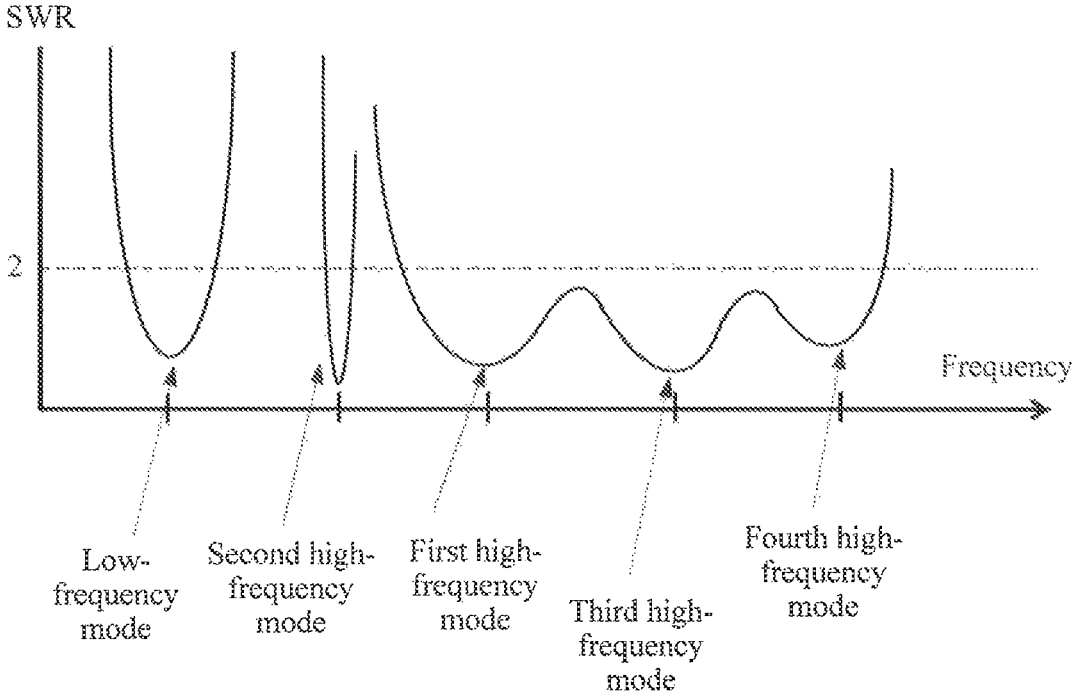
FIG. 3E is a schematic diagram of a standing wave ratio of an antenna apparatus according to Embodiment 2 of the present disclosure.

Moreover, FIG. 3A shows that the antenna apparatus 2 is connected to the low-frequency switching network 20, but the fixed end of the single-pole three-throw switch 200 is connected to the second movable end, that is, FIG. 3A shows a schematic diagram of a standing wave ratio of the antenna apparatus 2 when the first ground terminal 21 is directly connected. Certainly, a schematic diagram of a standing wave ratio of the antenna apparatus 1 of Embodiment 1 is similar to the schematic diagram of the standing wave ratio of the antenna apparatus 2. FIG. 3B shows a schematic diagram of a standing wave ratio when the fixed end of the single-pole three-throw switch 200 is connected to the first movable end. Because there are two low-frequency matching components in this case, which are respectively the inductor 201 and inductor 202, there are also two first movable ends for respectively connecting to these inductors. Further, it can be seen from FIG. 3B that, when the inductor 201 and the inductor 202 are separately connected between the fixed end of the single-pole three-throw switch 200 and the first ground terminal 21, the low-frequency mode of the antenna apparatus 2 may shift. Values of the two inductors are different, therefore, a shift quantity of the low-frequency mode to a lower frequency is also different (generally, at least coverage from long term evolution (LTE) band 700 to LTE band B8 may be designed). However, the four high-frequency modes of the antenna apparatus 2 are not affected. It can be seen that, by connecting the low-frequency switching network 20, a frequency covered by the low-frequency mode of the antenna apparatus 2 may be adjusted. This type of antenna is applicable to a carrier aggregation (CA) scenario. Moreover, compared with FIG. 3A, the four high-frequency modes covered by the antenna apparatus 2 can be interchanged. For details, refer to FIG. 3E. The covered bands enumerated above are still used as examples. In this case, the low-frequency mode correspondingly covers the first band, and the first band 698 MHz to 960 MHz may be changed to cover 880 MHz to 960 MHz. In this case, the foregoing first frequency and second frequency are respectively 880 MHz and 960 MHz, and the first, third, and fourth high-frequency modes may be combined to cover a wide bandwidth, for example, generally from 1710 MHz to 2690 MHz. In this case, the second high-frequency mode may cover a preset band, and the preset band may be used to support a GPS or a GNSS, or the preset band is LTE band 11, that is, a band from 1427 MHz to 1495 MHz customized for an operator, such as KDDI or SKB in Japan, or is LTE band 21, that is, 1448 MHz to 1511 MHz. It should be noted that, when the five modes in which the antenna apparatus 1 or the antenna apparatus 2 described above operates, that is, the low-frequency mode and the first to fourth high-frequency modes, cover five gradually increasing bands along a number axis, as shown in FIG. 3A and FIG. 3B, ranges of the foregoing first to five bands are arranged in an increasing sequence, and the five bands correspond to the five modes sequentially, that is, the low-frequency mode corresponds to the first band, and the first to fourth high-frequency modes respectively correspond to the second to fifth bands sequentially. As shown in FIG. 3C to FIG. 3E, the five bands are still arranged in an increasing sequence, but do not necessarily correspond to the five modes sequentially. For example, band locations corresponding to the four high-frequency modes are uncertain. Therefore, in FIG. 3A, the second band corresponds to the first high-frequency mode, but in FIG. 3E, the second band corresponds to the second high-frequency mode.

Figure 4A:
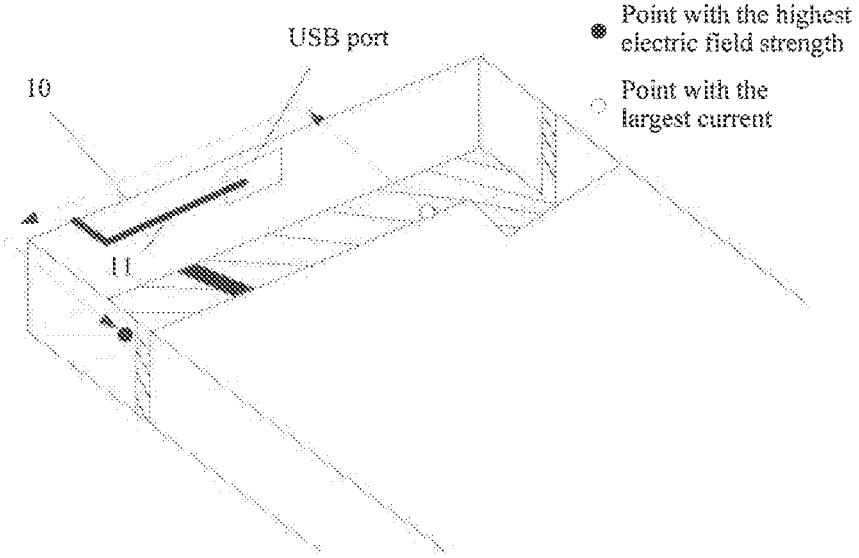
FIG. 4A is a schematic diagram of a current mode of an antenna apparatus according to Embodiment 2 of the present disclosure.
Figure 4B:
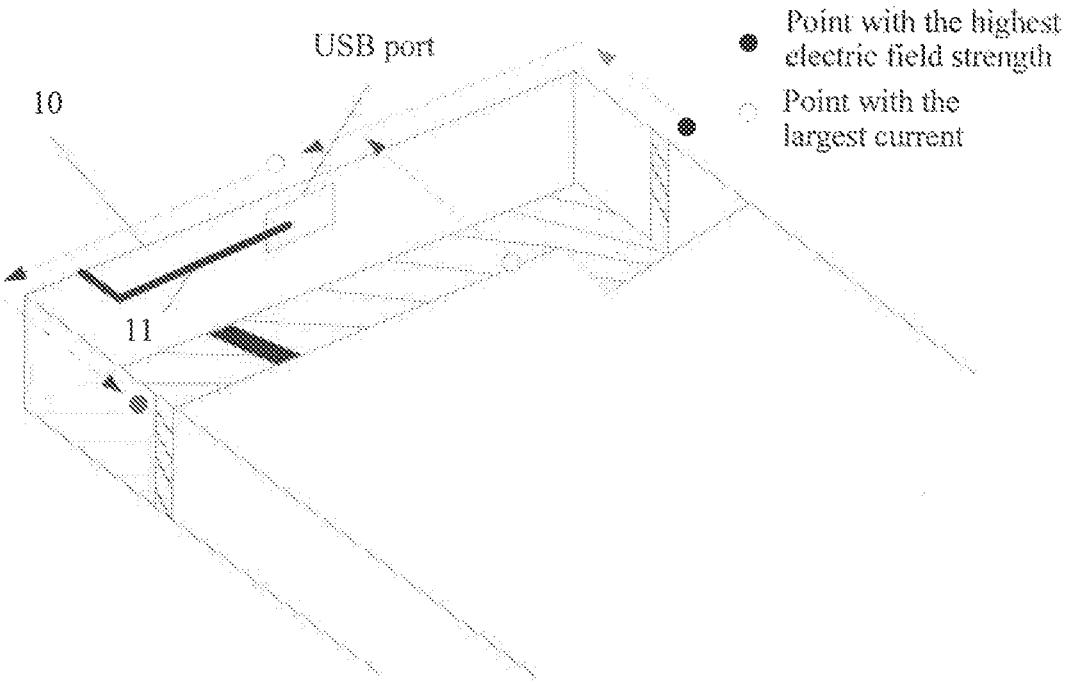
FIG. 4B is a schematic diagram of a current mode of an antenna apparatus according to Embodiment 2 of the present disclosure.
Figure 4C:
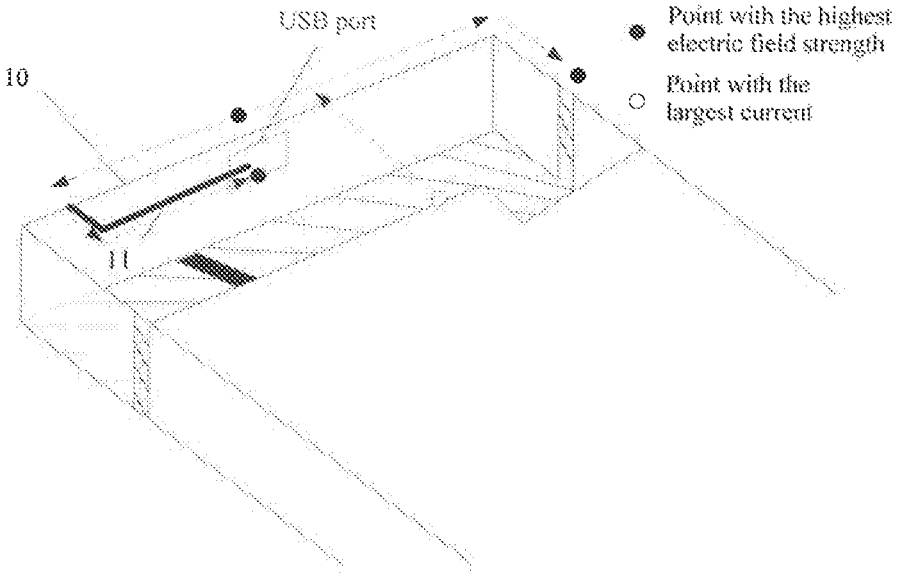
FIG. 4C is a schematic diagram of a current mode of an antenna apparatus according to Embodiment 2 of the present disclosure.
Figure 4D:
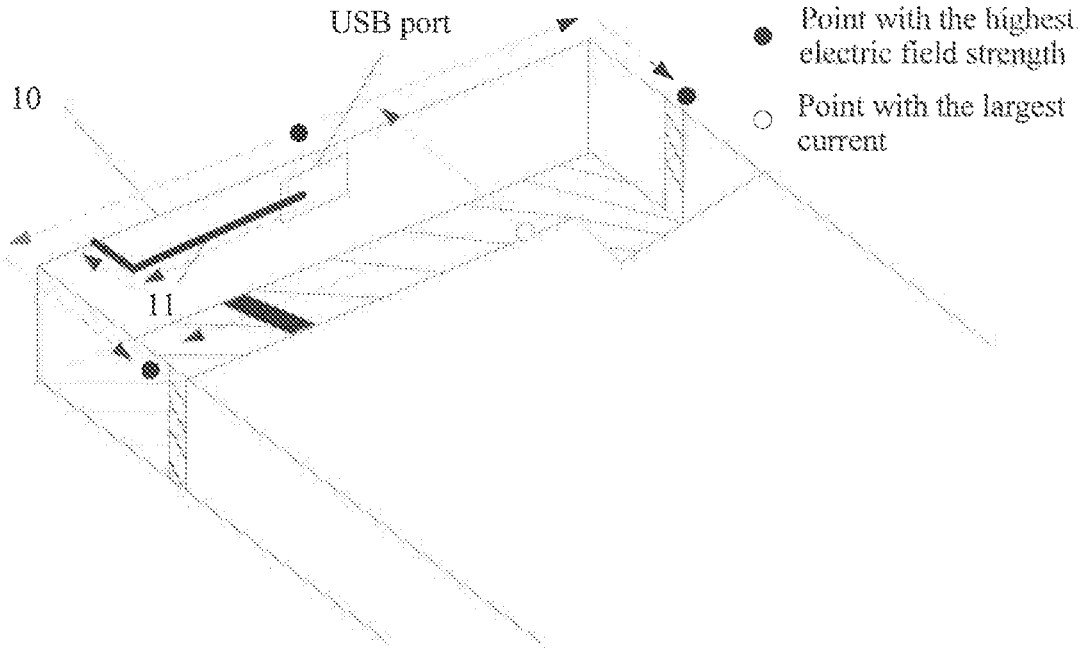
FIG. 4D is a schematic diagram of a current mode of an antenna apparatus according to Embodiment 2 of the present disclosure.
Figure 4E:
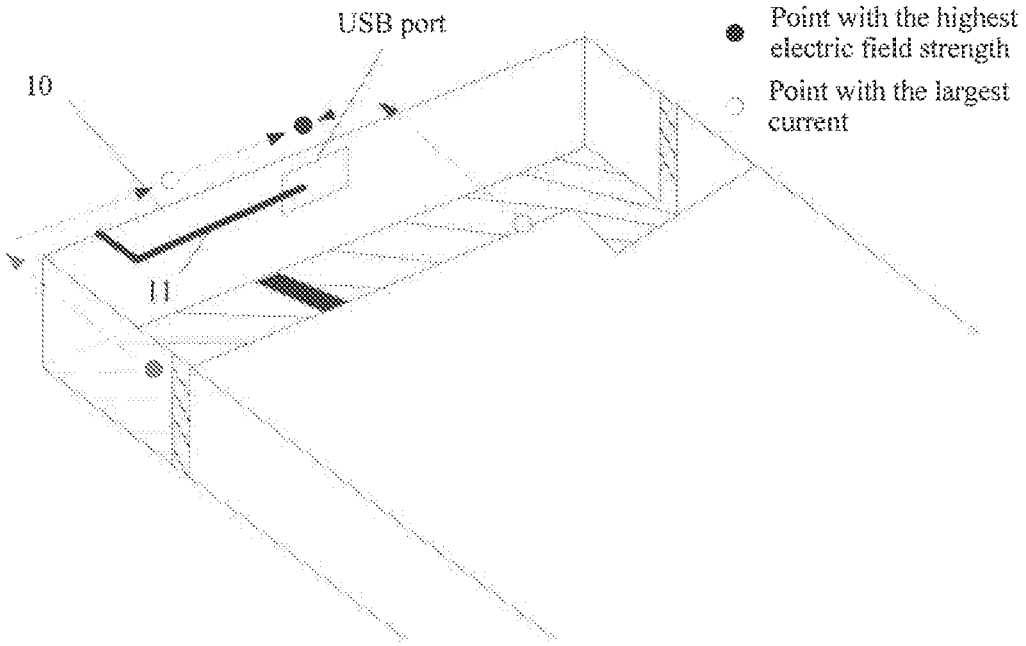
FIG. 4E is a schematic diagram of a current mode of an antenna apparatus according to Embodiment 2 of the present disclosure.

FIG. 4A to FIG. 4E show schematic diagrams of current mode resonance of the antenna apparatus 2 in five operating modes. FIG. 4A to FIG. 4E sequentially correspond to the foregoing five modes, a black dashed arrow represents a current direction in the five resonance modes, a black solid dot represents a point with the highest electric field strength, and a hollow dot represents a point with the largest current. FIG. 4A is used as an example. A current flows from the location of the feed terminal 12 (that is, a location of the hollow dot in FIG. 4A) connected to the feed to the first open-circuit end 100 (that is, a location of the black solid dot in FIG. 4A, and a gap at a bezel on a left side of the terminal) in order to form quarter-wavelength resonance in the low-frequency mode. A principle of FIG. 4B to FIG. 4E is similar to that of FIG. 4A, and details are not described herein. It should be noted that the point with the largest current or the point with the highest electric field strength shown in FIG. 4A to FIG. 4E are merely examples, and are not used as limitations. It should be noted that FIG. 4A to FIG. 4E are resonance mode diagrams shown on partial schematic structural diagrams of the terminal. In this case, the antenna body 10 in the antenna apparatus 2 is a metal housing of the terminal. An opening is a universal serial bus (USB) port, a part with black oblique lines represents a gap formed by the antenna body 10 and the metal housing of the terminal by facing each other, and a black solid part in the black oblique lines represents a radio frequency switch of the antenna. A specific terminal structure and gap formation are described in detail in subsequent embodiments.

With reference to the resonance modes and corresponding covered bands described above, a current direction shown in FIG. 4A corresponds to the quarter-wavelength resonance in the low-frequency mode, and the antenna apparatus 2 may cover 698 MHz to 960 MHz. A current direction shown in FIG. 4B corresponds to half-wavelength resonance, and a center frequency of a band covered by the antenna apparatus 2 is 1.85 gigahertzes (GHz). A current direction shown in FIG. 4C corresponds to three-quarter-wavelength resonance, and a center frequency of a band covered by the antenna apparatus 2 is 2.2 GHz. A current direction shown in FIG. 4D corresponds to single-wavelength resonance, and a center frequency of a band covered by the antenna apparatus 2 is 2.5 GHz. A current direction shown in FIG. 4E corresponds to three-quarter-wavelength resonance, and a center frequency of a band covered by the antenna apparatus 2 is 3.3 GHz.

It should be noted that the antenna apparatus 2 in FIG. 2 is described only using two inductors as an example. It can be seen that, in practice, if the antenna apparatus 2 needs to cover more different bands in the low-frequency mode, more inductors may be connected to the first movable ends of the single-pole three-throw switch 200.

When the antenna apparatus is applied, the metal housing of the terminal may be used as the antenna body of the terminal, that is, a shape of the antenna body matches the metal housing. In this disposition manner, generally, only a clearance area less than 3 millimeters is needed.

The antenna apparatus provided in this embodiment of the present disclosure includes the antenna body and at least one stub, where the feed terminal is disposed on the antenna body, one end of the stub is electrically connected to the connection point between the feed terminal and the first open-circuit end of the antenna body, and the other end of the stub is an open-circuit end, and the antenna body length between the connection point and the feed terminal is a half of the wavelength corresponding to the specified operating frequency of the antenna apparatus, and the length of the stub is one quarter of the wavelength corresponding to the specified operating frequency. Compared with an existing terminal antenna, when the antenna apparatus is used, an appearance design of the terminal can be fully used such that only small clearance space needs to be occupied while an overall screen-to-body ratio is high.

Figure 5:
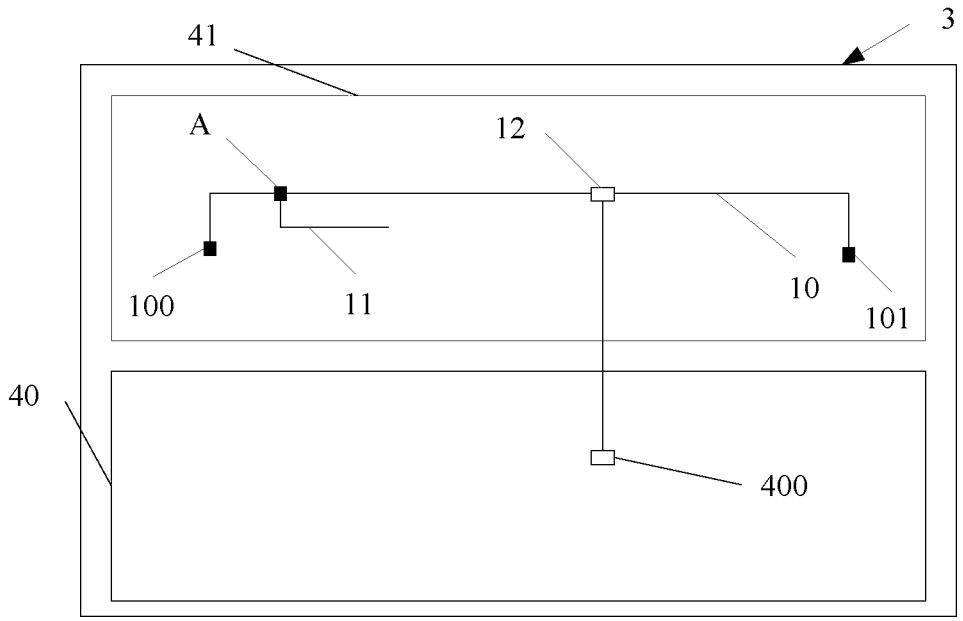
FIG. 5 is a schematic structural diagram of a terminal according to Embodiment 3 of the present disclosure.

FIG. 5 is a terminal provided by Embodiment 3 of the present disclosure. As shown in FIG. 5, the terminal 3 includes a printed circuit board 40 and an antenna apparatus 41.

Further, a feed apparatus 400 is disposed on the printed circuit board 40. The antenna apparatus 41 may be either of the antenna apparatuses described in Embodiment 1 and Embodiment 2. In an example in which the antenna apparatus 41 is the antenna apparatus 1 in Embodiment 1, a feed terminal 12 in the antenna apparatus 41 is connected to the feed apparatus 400.

Certainly, in an example in which the antenna apparatus 41 is the antenna apparatus 2 in Embodiment 2, the antenna apparatus 41 includes a first ground terminal. Therefore, in this case, a ground terminal is further disposed on the printed circuit board 40, and the ground terminal is electrically connected to the first ground terminal. If the antenna apparatus 41 further includes a second ground terminal, the ground terminal is also electrically connected to the second ground terminal. Details are not shown with the figure or described herein.

The terminal 3 provided in this embodiment of the present disclosure includes the printed circuit board 40 and the antenna apparatus 41, where the feed apparatus 400 is disposed on the printed circuit board 40, and the feed terminal 12 in the antenna apparatus 41 is electrically connected to the feed apparatus 400. The antenna apparatus 41 may include an antenna body 10 and at least one stub 11. The feed terminal 12 is disposed on the antenna body 10. One end of the stub 11 is electrically connected to a connection point A between the feed terminal 12 and a first open-circuit end 100 of the antenna body 10, and the other end of the stub 11 is an open-circuit end. An antenna body 10 length between the connection point A and the feed terminal 12 is a half of a wavelength corresponding to a specified operating frequency of the antenna apparatus 41, and a length of the stub 11 is one quarter of the wavelength corresponding to the specified operating frequency. Compared with an existing terminal, when the antenna apparatus 41 is used, an appearance design of the terminal can be fully used such that only small clearance space needs to be occupied while performance is ensured.

Figure 6:
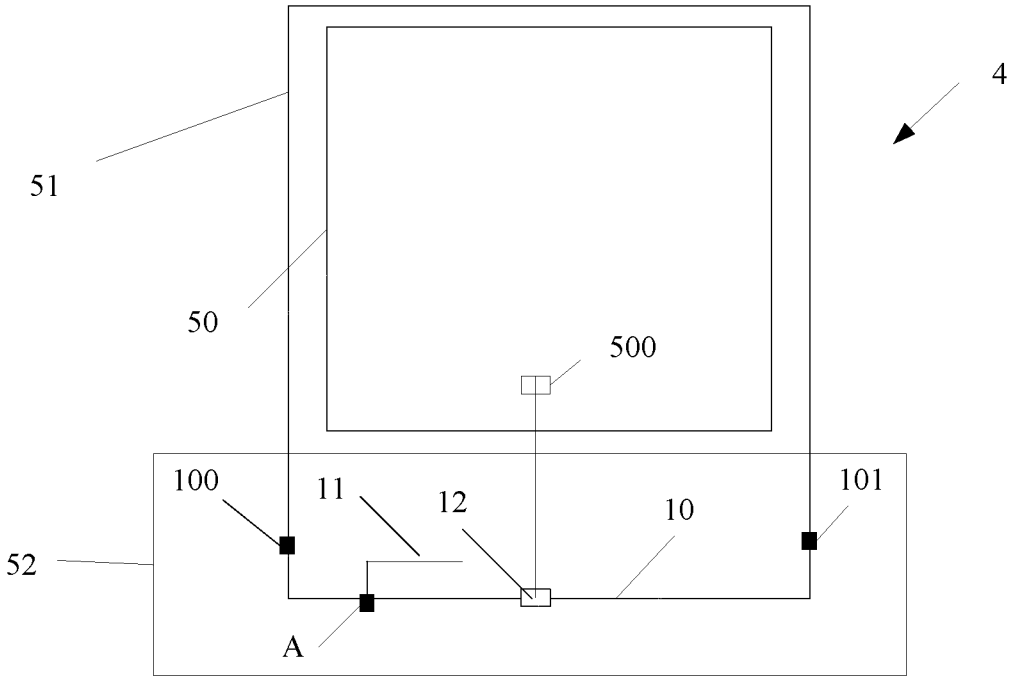
FIG. 6 is a schematic structural diagram of a terminal according to Embodiment 4 of the present disclosure.

FIG. 6 is a terminal 4 provided by Embodiment 4 of the present disclosure. As shown in FIG. 6, the terminal 4 includes a printed circuit board 50, a ground metal housing 51, and an antenna apparatus 52.

Further, the printed circuit board 50 is located inside the ground metal housing 51. A feed apparatus 500 is disposed on the printed circuit board 50. The printed circuit board 50 is electrically connected to the ground metal housing 51, that is, the printed circuit board 50 is connected to the ground metal housing 51 and is grounded (a connection relationship is not shown in the figure).

The ground metal housing 51 has a hollow structure.

The antenna apparatus 52 may be either of the antenna apparatuses described in Embodiment 1 and Embodiment 2. In an example in which the antenna apparatus 52 is the antenna apparatus 1 in Embodiment 1, a feed terminal 12 in the antenna apparatus 52 is electrically connected to the feed apparatus 500, and a gap is formed between an antenna body 10 in the antenna apparatus 52 and the ground metal housing 51. The gap is not shown herein, and is shown in another accompanying drawing below.

It should be noted that, in an example in which the antenna apparatus 52 is the antenna apparatus in Embodiment 2, the antenna apparatus 52 includes a first ground terminal. Therefore, in this case, a ground terminal is further disposed on the printed circuit board 50, and the ground terminal is electrically connected to the first ground terminal. If the antenna apparatus 52 further includes a second ground terminal, the ground terminal is also electrically connected to the second ground terminal. Details are not shown with the figure or described herein.

Figure 7A:
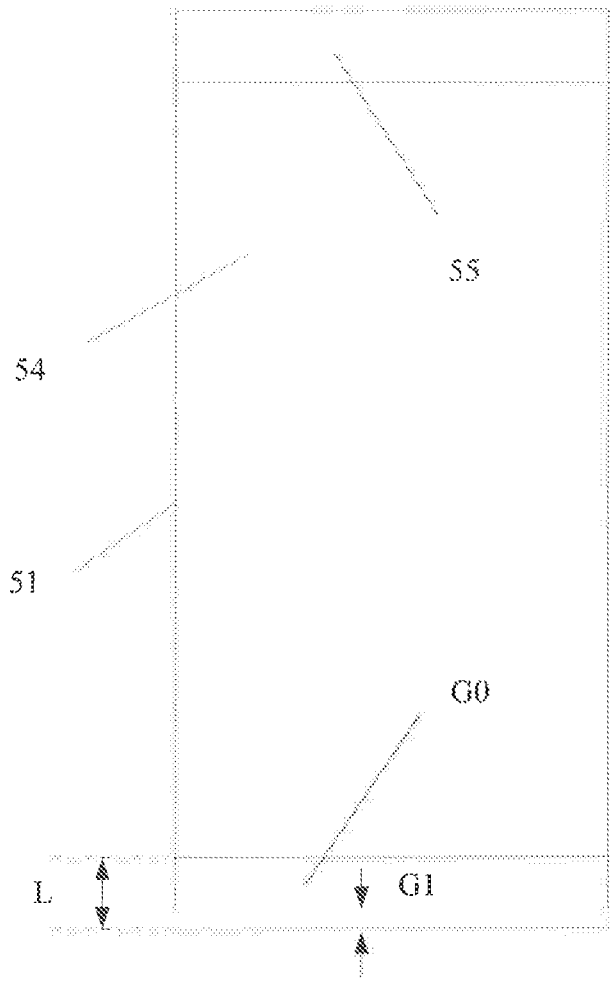
FIG. 7A is a front view of a terminal according to Embodiment 4 of the present disclosure.

FIG. 7A is a front view of the terminal 4. It can be seen from the figure that a front facet of the terminal 4 includes a screen 54, a plastic part 55, the ground metal housing 51, and an area G0. A width of the area G0 is L, as shown in FIG. 7A. The screen 54 may be a liquid crystal display, a touchscreen, or the like. The plastic part 55 is located on one side of the screen 54, and the area G0 is located on the other side of the screen 54. The area G0 includes an antenna disposition area (an area outlined by a dashed line) and a screen module disposition area. The antenna disposition area includes the antenna apparatus 52 and a clearance area G1 required for disposing an antenna. Plastic may be selected as a material of the area G1 on the front facet of the terminal, and a non-plastic material, such as metal, may be selected for an area other than G1 in the area G0. For front views of the terminals shown in FIG. 7B, FIG. 7C, and FIG. 8A to FIG. 8G, reference may be made to FIG. 7A.

Further, the terminal includes two antenna apparatuses 52. One antenna apparatus 52 is disposed in the area G1 shown in FIG. 7A, and the other antenna apparatus 52 is disposed in the plastic part 55 shown in FIG. 7A. That is, the two antenna apparatuses 52 are disposed in the terminal in up-down symmetry. The two antenna apparatuses 52 may also operate alternately using a switching circuit additionally disposed in the terminal.

Figure 7B:
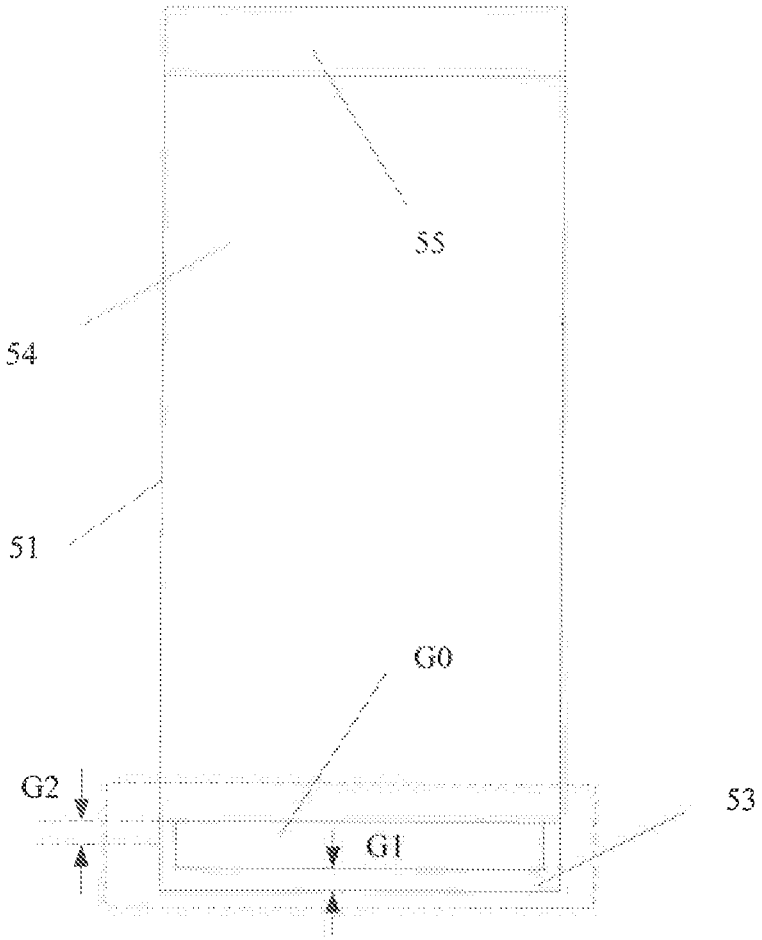
FIG. 7B is a rear view of a terminal according to Embodiment 4 of the present disclosure.
Figure 7C:
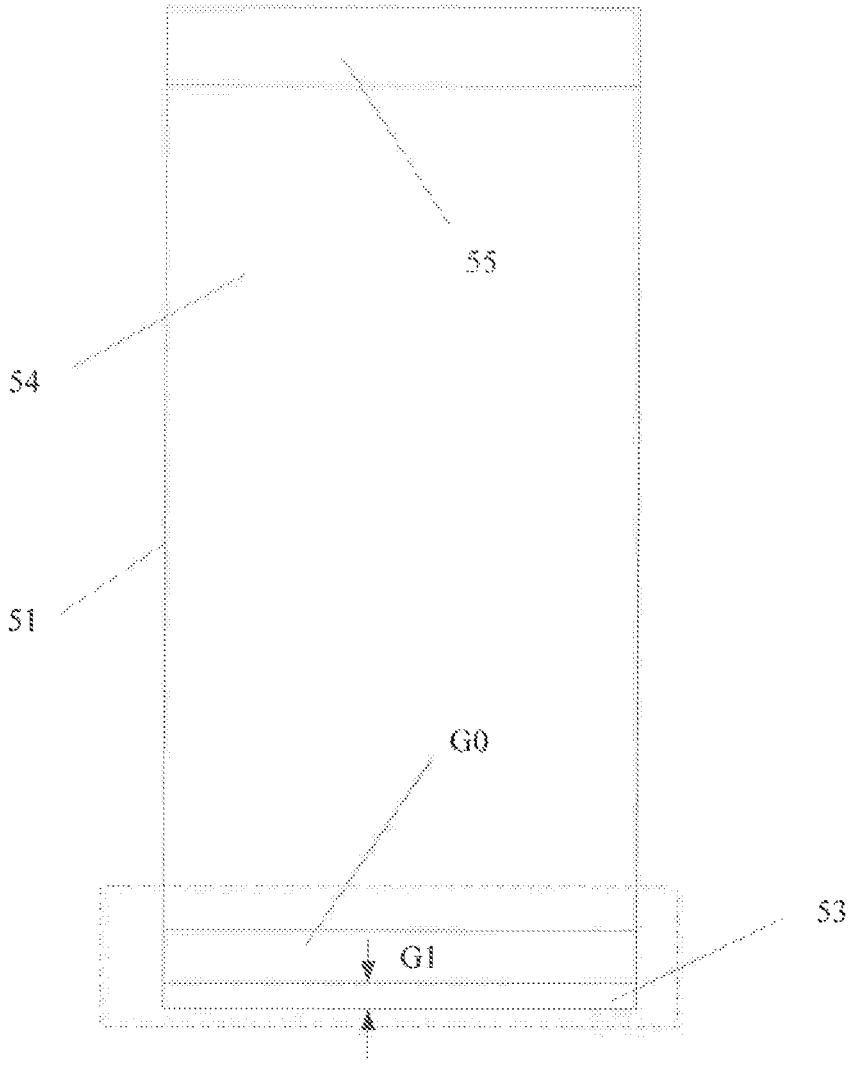
FIG. 7C is a rear view of another terminal according to Embodiment 4 of the present disclosure.
Figure 8A:
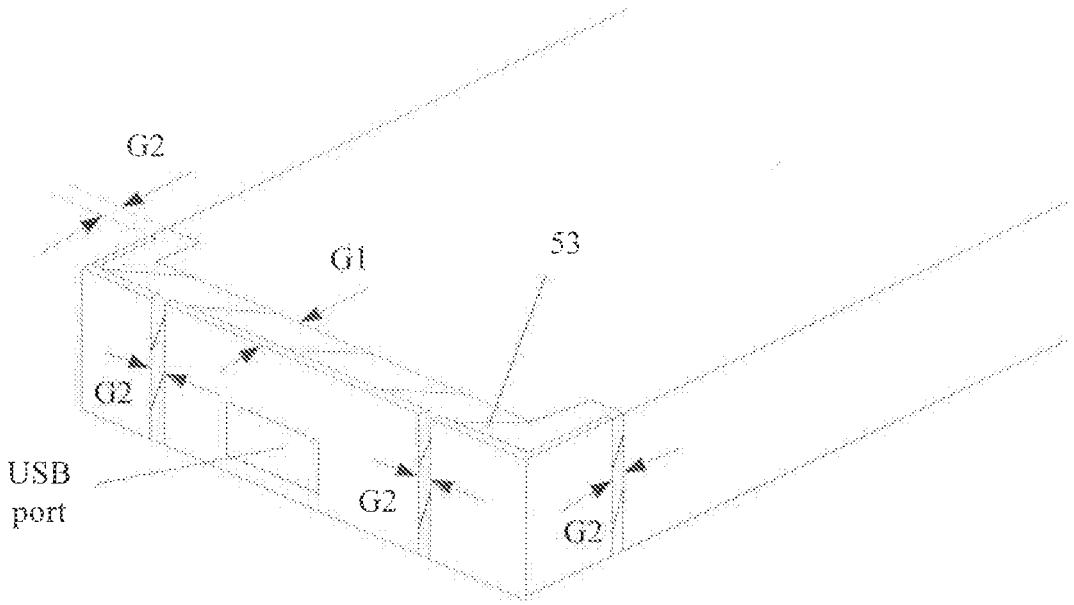
FIG. 8A is a partial schematic diagram of a terminal according to Embodiment 4 of the present disclosure.
Figure 8B:
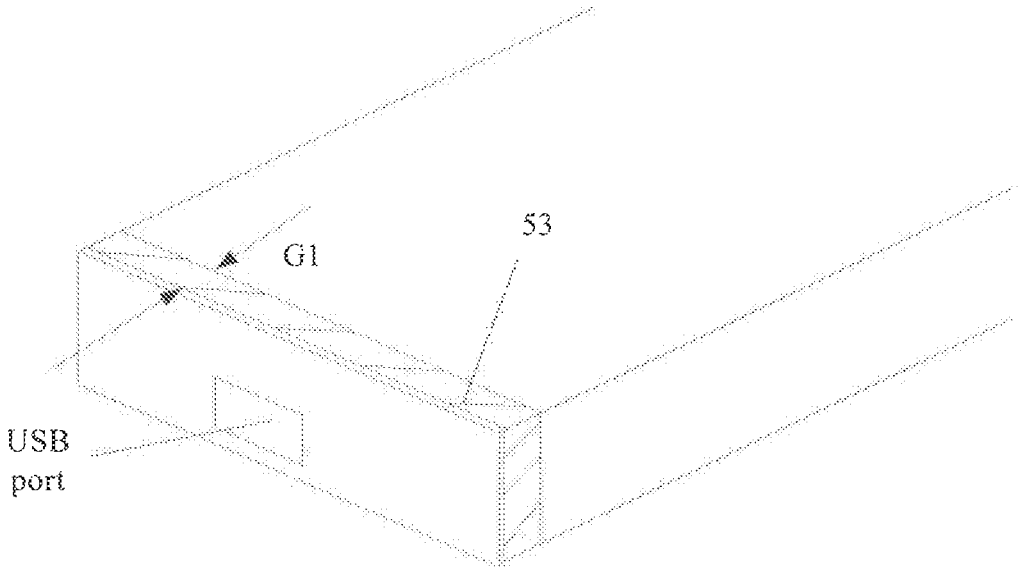
FIG. 8B is a partial schematic diagram of another terminal according to Embodiment 4 of the present disclosure.
Figure 8C:
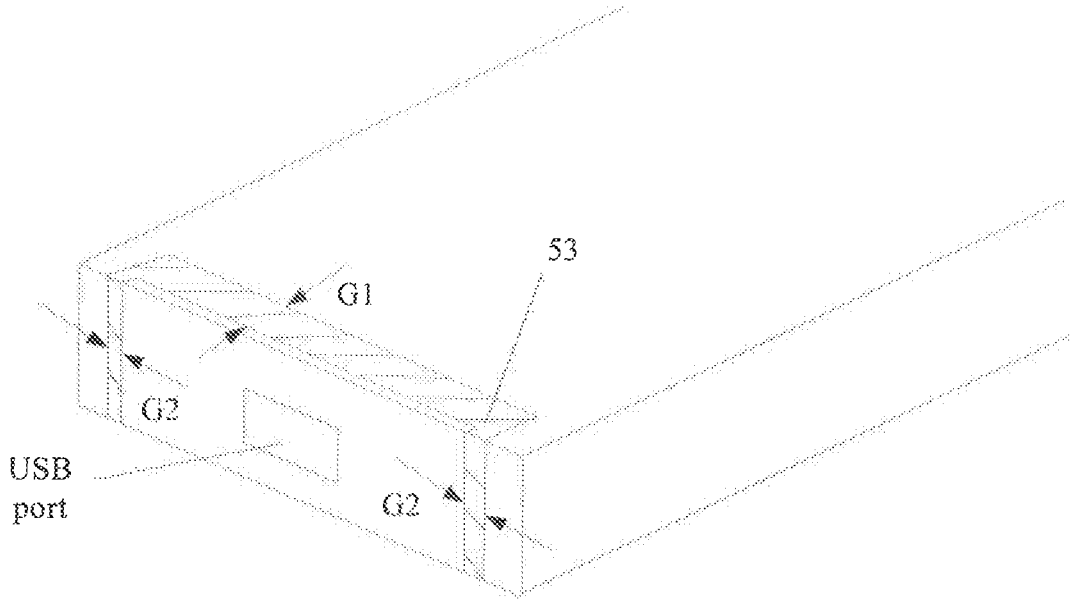
FIG. 8C is a partial schematic diagram of another terminal according to Embodiment 4 of the present disclosure.
Figure 8D:
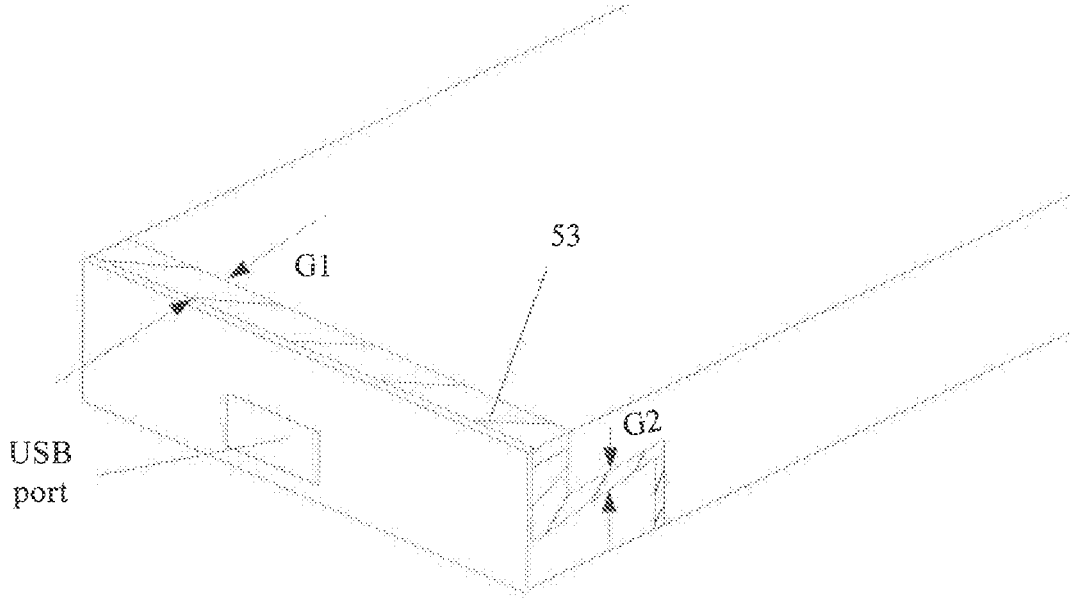
FIG. 8D is a partial schematic diagram of another terminal according to Embodiment 4 of the present disclosure.
Figure 8E:
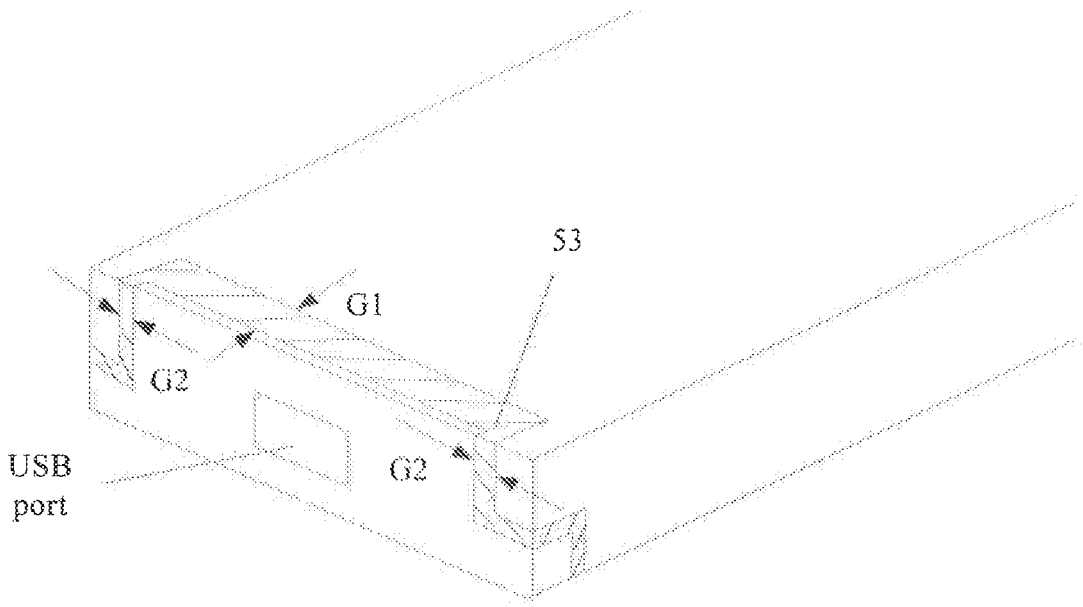
FIG. 8E is a partial schematic diagram of another terminal according to Embodiment 4 of the present disclosure.
Figure 8F:
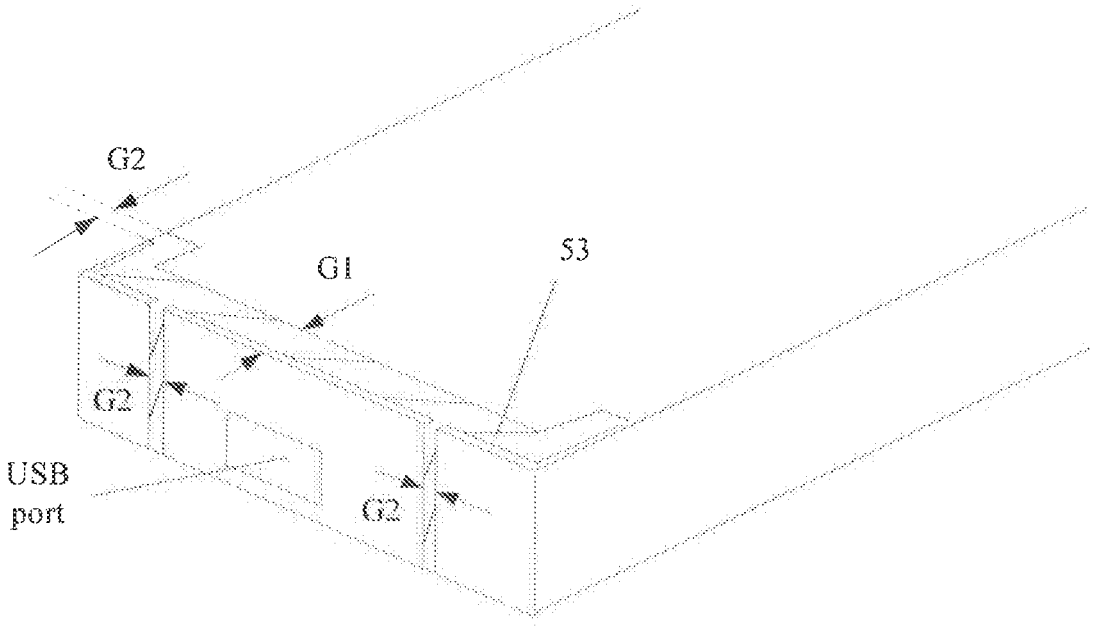
FIG. 8F is a partial schematic diagram of another terminal according to Embodiment 4 of the present disclosure.
Figure 8G:
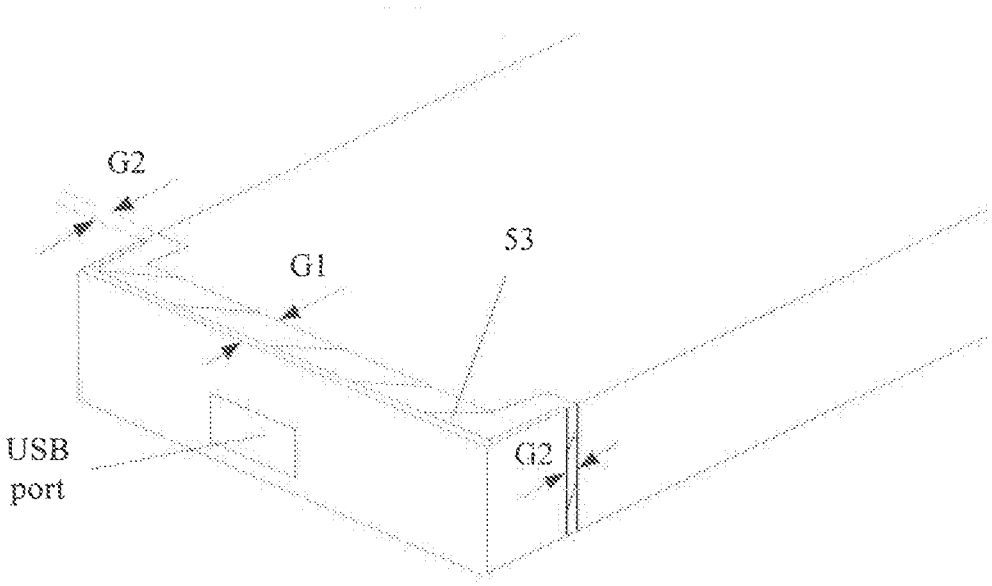
FIG. 8G is a partial schematic diagram of another terminal according to Embodiment 4 of the present disclosure.

FIG. 7B shows a rear view of the terminal 4, including the ground metal housing 51 and the clearance area G1. The antenna body 10 and the ground metal housing 51 face each other to form the gap 53, and therefore, the antenna body 10 can radiate out an electromagnetic wave through the gap 53. Optionally, a non-conductive material such as plastic may be filled in the gap 53 in a built-in, fill-in, or injection molding manner. In this case, the antenna apparatus 52 is located in a dashed-line box area shown in the rear view of FIG. 7B. A width of a rear facet gap G1 of the clearance area of the antenna apparatus 52 is generally less than 3 millimeters, and a width of a side facet gap G2 of the antenna apparatus 52 is generally between 1.5 millimeters and 2.0 millimeters. A typical display module generally occupies space of about 5 millimeters, and therefore a total width of L is less than 8 millimeters. Therefore, using the terminal whose G1 is less than 3 millimeters in this embodiment of the present disclosure, only small clearance space needs to be occupied while a high screen-to-body ratio is ensured.

Optionally, a dielectric with a high dielectric constant may be filled in the gap 53 in order to extend a low-frequency bandwidth to a super low frequency, for example to cover LTE band 700, thereby providing broader wideband coverage. Moreover, optionally, from an aspect of material, a filler in the gap 53 may be made of a plastic material. The plastic material may be in a transparent or non-transparent modality, and different colors or patterns may also be coated on the plastic material, thereby achieving an aesthetic and decorative effect.

From an aspect of shape, it can be seen from the back of the terminal 4 that, the gap 53 may be U-shaped (for example, in FIG. 7B, FIG. 8A, FIG. 8F, and FIG. 8G), or may be linear (for example, in FIG. 7C, FIG. 8B, FIG. 8C, FIG. 8D, and FIG. 8E). The gap 53 may extend from the back of the terminal to the front of the terminal through a side edge of the terminal (for example, in FIG. 8B, FIG. 8D, and FIG. 8G), or the gap 53 may extend from the back of the terminal to the front of the terminal through a bottom edge of the terminal (for example, in FIG. 8C, FIG. 8E, and FIG. 8F), or the gap 53 may extend from the back of the terminal to the front of the terminal through both a side edge and a bottom edge (for example, in FIG. 8A). A specific shape of the gap 53 is not limited herein, and the shapes of the gap 53 shown in the accompanying drawings of the present disclosure are merely examples.

It should be noted that FIG. 8A to FIG. 8G merely show a partial design of the terminal gap instead of an overall schematic diagram of the terminal. For the shape of the antenna apparatus, reference may be made to other accompanying drawings, where an opening may be a USB port, and a part with oblique lines is the gap 53.

The terminal provided in this embodiment of the present disclosure includes the printed circuit board, the ground metal housing, and the antenna apparatus. The antenna apparatus may include the antenna body and at least one stub. The feed terminal is disposed on the antenna body, one end of the stub is electrically connected to a connection point between the feed terminal and a first open-circuit end of the antenna body, and the other end of the stub is an open-circuit end, and an antenna body length between the connection point and the feed terminal is a half of a wavelength corresponding to a specified operating frequency of the antenna apparatus, and a length of the stub is one quarter of the wavelength corresponding to the specified operating frequency. Compared with an existing terminal, when the antenna apparatus is used, an appearance design of the terminal can be fully used such that only small clearance space needs to be occupied while performance is ensured.

It should be noted that the accompanying drawings in the present disclosure are not necessarily drawn in proportion unless otherwise specified.

Finally, it should be noted that the foregoing embodiments are merely intended for describing the technical solutions of the present disclosure, but not for limiting the present disclosure. Although the present disclosure is described in detail with reference to the foregoing embodiments, a person of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. An antenna apparatus, comprising:

an antenna body;

a feed terminal disposed on the antenna body;

a stub, wherein one end of the stub is electrically coupled to a coupling point between the feed terminal and a first open-circuit end of the antenna body, and wherein another end of the stub comprises an open-circuit end;

an antenna body length between the coupling point and the feed terminal comprising a half of a wavelength corresponding to a specified operating frequency of the antenna apparatus; and a length of the stub comprising one quarter of the wavelength corresponding to the specified operating frequency.

2. The antenna apparatus of claim 1, further comprising:

a low-frequency switching network, wherein one end of the low-frequency switching network is electrically coupled between the feed terminal and the coupling point; and a first ground terminal electrically coupled to another end of the low-frequency switching network.

3. The antenna apparatus of claim 2, wherein the low-frequency switching network comprises:

a single-pole multi-throw switch, wherein a fixed end of the single-pole multi-throw switch is coupled between the feed terminal and the coupling point; and a first low-frequency matching component electrically coupled between a first movable end of the single-pole multi-throw switch and the first ground terminal, wherein a second movable end of the single-pole multi-throw switch is electrically coupled to the first ground terminal.

4. The antenna apparatus of claim 3, wherein the low-frequency matching component comprises a capacitor.

5. The antenna apparatus of claim 3, wherein the low-frequency matching component comprises an inductor.

6. The antenna apparatus of claim 1, wherein the antenna apparatus is configured to operate on a first band, a second band, a third band, a fourth band, and a fifth band, wherein the first band comprises between 698 megahertz (MHz) and 960 MHz, and wherein the second band, the third band, the fourth band, and the fifth band comprise between 1710 MHz and 3600 MHz.

7. The antenna apparatus of claim 6, wherein the second band, the third band, the fourth band, and the fifth band comprise between 1710 MHz and 2690 MHz.

8. The antenna apparatus of claim 1, wherein the antenna apparatus is configured to operate on a first band, a second band, a third band, a fourth band, and a fifth band, wherein the first band comprises between 698 megahertz (MHz) and 960 MHz, wherein the second band is a preset band comprising 1427 MHz to 1511 MHz, and wherein the third band, the fourth band, and the fifth band comprise between 1710 MHz and 2690 MHz.

9. The antenna apparatus of claim 8, wherein the first band comprises between 880 MHz and 960 MHz.

10. The antenna apparatus of claim 1, further comprising:

a second ground terminal disposed between the feed terminal and a second open-circuit end of the antenna body.

11. The antenna apparatus of claim 1, wherein the antenna body comprises a metal housing.

12. The antenna apparatus of claim 1, wherein the antenna apparatus is configured to operate on a first band, a second band, a third band, a fourth band, and a fifth band, wherein the first band comprises between 698 megahertz (MHz) and 960 MHz, wherein the second band is a preset band supporting a Global Positioning System (GPS), and wherein the third band, the fourth band, and the fifth band comprise between 1710 MHz and 2690 MHz.

13. The antenna apparatus of claim 1, wherein the antenna apparatus is configured to operate on a first band, a second band, a third band, a fourth band, and a fifth band, wherein the first band comprises between 698 megahertz (MHz) and 960 MHz, wherein the second band is a preset band supporting a Global Navigation Satellite System (GNSS), and wherein the third band, the fourth band, and the fifth band comprise between 1710 MHz and 2690 MHz.

14. The antenna apparatus of claim 1, wherein the antenna apparatus is configured to operate on a first band, a second band, a third band, a fourth band, and a fifth band, and wherein the first band comprises a low-frequency mode.

15. The antenna apparatus of claim 1, wherein the antenna apparatus is configured to operate on a first band, a second band, a third band, a fourth band, and a fifth band, and wherein the second band, the third band, the fourth band, and the fifth band comprise a high-frequency mode.

16. The antenna apparatus of claim 1, wherein the antenna apparatus is configured to support local area network communication, voice and data cellular phone communication, GPS communication, satellite navigation system communication, or BLUETOOTH communication.

17. The antenna apparatus of claim 3, wherein the single-pole multi-throw switch is a single-pole three-throw switch.

18. The antenna apparatus of claim 3, further comprising a second low-frequency matching component electrically coupled between the second movable end of the single-pole multi-throw switch and the first ground terminal.

19. A terminal comprising an antenna apparatus, wherein the antenna apparatus comprises:

an antenna body;

a feed terminal disposed on the antenna body;

a stub, wherein one end of the stub is electrically coupled to a coupling point between the feed terminal and a first open-circuit end of the antenna body, and wherein another end of the stub comprises an open-circuit end;

an antenna body length between the coupling point and the feed terminal comprising a half of a wavelength corresponding to a specified operating frequency of the antenna apparatus; and a length of the stub comprising one quarter of the wavelength corresponding to the specified operating frequency.

20. The terminal of claim 19, wherein the terminal comprises a laptop computer, a tablet, a wristwatch device, a wristband device, a cellular phone, a media player, a set top box, a desktop computer, or a computer monitor.

* * * * *